United States Patent [19]

Wright

[11] Patent Number: 4,729,487

[45] Date of Patent: Mar. 8, 1988

[54] PUSH AND LOCK CHILD-RESISTANT CLOSURE

[76] Inventor: Frank S. Wright, 109 W. 7th Ave., Dayton, Tenn. 37321

[21] Appl. No.: 53,019

[22] Filed: May 22, 1987

[51] Int. Cl.[4] ..... B65D 55/02

[52] U.S. Cl. ..... 215/220; 215/219

[58] Field of Search ..... 220/219, 220, 222

[56] References Cited

U.S. PATENT DOCUMENTS

| | | | |
|---|---|---|---|
| 4,011,960 | 3/1977 | Mauvernay et al. | 215/220 |
| 4,103,797 | 8/1978 | Morris | 215/209 |
| 4,285,437 | 8/1981 | Morris | 215/220 |
| 4,346,809 | 8/1982 | Kusz | 215/214 |
| 4,393,977 | 7/1983 | Willingham | 215/211 |
| 4,394,916 | 7/1983 | Smalley | 215/220 |
| 4,433,789 | 2/1984 | Gibilisco | 215/220 |
| 4,690,292 | 9/1987 | Henning | 215/219 |

*Primary Examiner*—George T. Hall

[57] ABSTRACT

A closure assembly is rotationally free in a child-resistant mode and is provided with a push-button to convert the closure to an operational mode. The closure assembly employs an inner cap, an outer cap, and a push-button selector assembled in a permanent nested configuration. A top portion of the selector is moveably received through an outer cap opening while lugs depending from the bottom surface of the outer cap are received by selector bottom portion slots to form a rotationally locked engagement, yieldingly radially flexible selector locking arms include a lip portion engaged within cam detents formed within the lugs and hold the selector in an axial outward position wherein rotating the outer cap transmits no rotational torque to the inner cap, depressing the selector causes the lips to track the cam detents and the lips snap outward under the lugs when the selector is fully depressed wherein selector rotational driving means are in an axial engageable relationship with inner cap rotational driving means. Subsequently depressing the outer cap causes the lugs to force the lips inward; when the lugs contact the top of the inner cap the lips are again engaged within the cam detents wherein the cam detents translate the radially outward biasing force of the locking arms to axial outward biasing force and cause the selector to return to the first position.

15 Claims, 13 Drawing Figures

PUSH AND LOCK CHILD-RESISTANT CLOSURE

BACKGROUND

1. Field of the Invention

The present invention relates to a container closure which has "child-resistant" and "not child-resistant" positions.

2. Background-Description of the Prior Art

Many types of container closures that are difficult for young children to operate have been known in prior art and are generally designated as "child-resistant" closures. It is often the case, however, that the means employed to render a closure "child-resistant" makes the closure difficult to operate by adult users, especially in the case where a physical disability caused by either a physical injury to the hand or a disease process such as arthritis, as by way of example, decreases manual dexterity. Accordingly, many pharmaceutical companies provide "not child-resistant" closures for their product containers and many adults request "not child-resistant" closures for prescription medicine containers.

In response to many adults not wanting "child-resistant" closures for product containers, closures having "child-resistant" and "not child-resistant" positions have been disclosed in prior art such as the closure assembly disclosed by U.S. Pat. No. 4,346,809 to Kusz. Kusz discloses a "child-resistant" closure assembly that utilizes a resiliant liner, that, when employed in one relative angular orientational alignment renders the closure "child-resistant," but may be removed and replaced in a particular angular orientational alignment to render the closure "not child-resistant." U.S. Pat. No. 4,103,797 to Morris discloses a unitary reversible closure for sealing a container that, when applied in one direction forms a "child-resistant" closure and when reversed end for end and reapplied to the container is "not child-resistant." Many adults, however, do not return closures to a "child-resistant" position because of the difficulty involvled or subsequent difficulty in removing the closure.

Another type of "child-resistant" closure assembly that is known in the prior art employs two or more closure members assembled in a permanent nested configuration. While many such closure assemblies are operated by two simultaneous movements, such as depressing the closure assembly while turning and are therefore difficult to operate by many adults, several closure assemblies are disclosed that employ means to simplify their operation. For example, U.S. Pat. No. 4,285,437 to Morris, discloses a closure assembly comprising two nested closure members assembled in a fixed axial relationship by a rotationally free engagement whereby the closure members rotate freely relative to each other. A push button tab formed therewith the outer closure member may be depressed when the outer closure member is in a particular angular orientational alignment to provide transmission of opening rotational torque to the inner closure member for subsequent removal of the closure assembly. When the closure is reapplied to the container, tightening the closure causes the tab to automatically return to the "child-resistant" position. Once a child learns the particular angular orientational alignment necessary to depress the tab and operate the closure, however, it is as easy for the child to operate the closure as the ease required by adult users.

It is also known in the prior art to provide a "child-resistant" closure and container assembly wherein the closure assembly may be converted to a "not child-resistant" position as exemplified by U.S. Pat. No. 4,393,977 to Willingham. Willingham discloses a closure- container assembly wherein axial pressure may be applied through an opening in the outer closure member to disengage an inner closure member from the container, wherein the closure assembly may be subsequently lifted from the container. Willingham's closure container assembly anticipates using a single axial movement to move the closure assembly to a "not child-resistant" position, but the closure assembly is of use only with the disclosed container and is not adaptable for use on containers employing closure rotational engagement means, such as, by way of example, containers with a threaded-neck portion.

As far as is known, it is not known in the prior art to provide a "child-resistant closure" assembly, for use on containers employing closure rotational engagement means, that may be moved to a "not child-resistant" position when the closure is in any relative angular orientational alignment by a single axial movement, remains in the "not child-resistant" position during subsequent use, and which can be returned to a "child-resistant" position by a further application of a single axial movement.

SUMMARY OF THE INVENTION

It is an object of the present invention to provide a closure assembly adaptable for use on containers employing closure rotational engagement means, wherein the closure assembly, in a "child-resistant" position rotates freely and cannot be removed from the container, but may be moved to a "not child-resistant" position by adult users by the application of a single axial movement for the subsequent removal thereof, by rotating the closure assembly. The closure assembly is comprised of an outer cap, an inner cap, and a push button selector assembled in a permanent nested configuration. An upstanding portion of the push button selector is moveably received through an opening in the outer cap and is rotationally locked therewith by outer cap axial locking lugs depending from the periphery of the outer cap opening moveably received therethrough selector bottom portion slots. Formed within the included angle of the selector bottom portion slots, radially inwardly flexible selector axial locking arms include a bottom lip portion engaged within outer cap axial locking lug cam detents and retains the selector in an axial relative outward first position. The outer-cap selector assembly engages telescopically over the inner cap and has a rotationally free engagement therewith including an intergaging annular tongue-and-groove whereby the outer cap-selector assembly rotates freely about the inner cap and transmits no rotational torque thereto. In any relative angular orientational alignment, axial pressure applied thereto the top of the selector through the outer cap opening, causes the selector axial locking lug lips to track (follow) the cam detents axially outward (relative to the cam detents) as the cam detents cammingly cause the locking arms to bend radially inward. The selector is in an axial relative inward second position when the selector locking arm lips track therebelow the outer cap locking lug, and the radially inwardly bent selector locking arms snap radially outward causing the lips to engage thereunder the locking lugs. Selector rotational driving means are in a relative axial engageable position in the selector axial relative inward second position and drivingly engage inner cap rotational driving means by rotating the outer cap whereby the closure assembly functions as a screw-type closure.

Yet another object of the present invention is to provide a closure assembly that is relatively easy to operate by adult users and relatively difficult to operate by children. The closure assembly is moved to a "not child-resistant" position by the application of a single axial inward force applied to the selector which is easy for adults but is difficult for young children because of the shape of the cam detents. The outer cap axial locking lug cam detents include a radially convexed outward axial inward first portion requiring the application of a proportionally increasing force applied to the selector before the locking arm lips can track the remaining portion of the cam detents. With the application of sufficient axial force, the selector "snaps" to the axial relative inward second position as opposed to moving axially iward in direct proportion to the amount of force applied. The selector, however, can only be depressed to the axial relative inward second position by depressing the selector without pressing inward on the outer cap. The outer cap-selector assembly is held in an axial relative outward first position by inner cap upstanding spring elements engaged under an outer cap, top portion bottom surface annular rim. Depressing the outer cap causes the spring elements to disengage the rim and bend radially inward and, acting conjointly with the outer cap skirt annular groove, allows the outer cap-selector assembly to move axially inward relative to the inner cap until the outer cap axial locking lugs contact the top of the inner cap. It is a salient feature of the present invention that the selector opening rotational driving means are not in axial relative engageable position by depressing the outer cap and further, the selector axial locking arm lips cannot engage thereunder the outer cap axial locking lugs when the outer cap is depressed. A child trying to depress the selector and having difficulty doing so, will invariably try and depress the selector while applying simultaneous force to the outer cap, and thereby be unable to lock the selector in the axial relative inward second position; upon releasing the force, the locking lug cam detents cause the selector to return to the axial relative outward first position (relative to the outer cap) while the inner cap spring elements yieldingly cause the outer cap-selector assembly to return to the the axial relative outward first position (relative to the inner cap).

Yet another object of the present invention is to provide a closure assembly which remains in the "not child-resistant" position during use but is easily returned to a "child-resistant" position. When the selector is in the axial relative inward (i.e.—"not child-resistant") position, there is no axial outward biasing force acting on the selector so adult users not wanting a "child-resistant" closure may leave the closure in this position indefinitely. Noting the closure is in a "not child-resistant" position from seeing that the selector is depressed or feeling the top of the closure, an adult can easily return the closure to the "child-resistant" position by depressing the outer cap. As mentioned previously, depressing the outer cap causes the outer cap axial locking lugs to move axially inward until contacting the top of the inner cap. When the selector is in the axial relative inward second position and the outer cap is depressed, the slightly rounded top surface of the selector axial locking arm lips cause the lips to move radially inward as the locking lugs move axially inward. When the locking lugs contact the top of the inner cap, the locking arm lips are engaged within the bottom portion of the cam detents, and the radially inwardly bent locking arms cause the selector to move axially outward as the lips track the cam detents radially outward and axially inward. The ease of converting the closure assembly between the two positions encourages adults to leave the closure in a "child resistant" position or return the closure to this position whenever there are children present.

Other objects advantages and features of the present invention will become apparent to those ordinarilly skilled in the art from the following detailed description taken in conjunction with the annexed drawings, wherein, by way of example, certain preferred embodiments of the present invention are illustrated.

DESCRIPTION OF THE PREFERRED EMBODIMENTS

Figure 1:
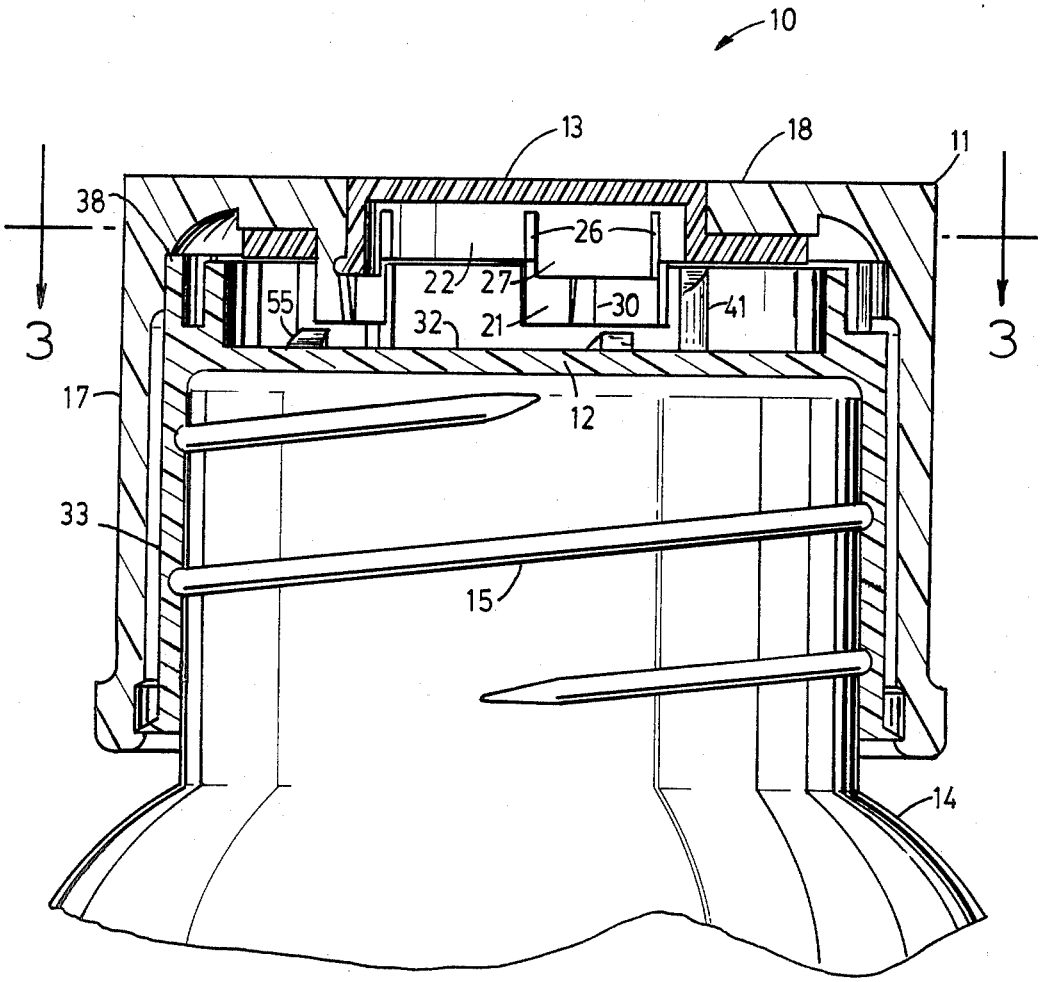
FIG. 1 is an axial sectional view of the present invention secured thereto the neck portion of a container, the closure assembly depicted in a child-resistant mode.

With reference to the drawings wherein like numberals designate like parts, and referring first to FIG. 1, there is shown a convertible child-resistant closure assembly 10 comprised of an outer cap 11, an inner cap 12, and a push button selector 13 assembled in a permanent nested configuration. Preferrably, the parts comprising the closure assembly are formed of thermoplastic material by injection molding, but the closure assembly is useful on containers formed of plastic, glass, or the like, such as illustrated container 14 wherein the inner cap is adapted to engage container threaded neck portion 15 to secure the closure thereto. As will become apparent in the following detailed disclosure, the present invention contemplates a means of selectively transmitting rotational torque therebetween the outer and inner caps, and, as such, any means of securing the closure thereto a container by employing a rotational movement of the inner cap may be used.

Figure 2:
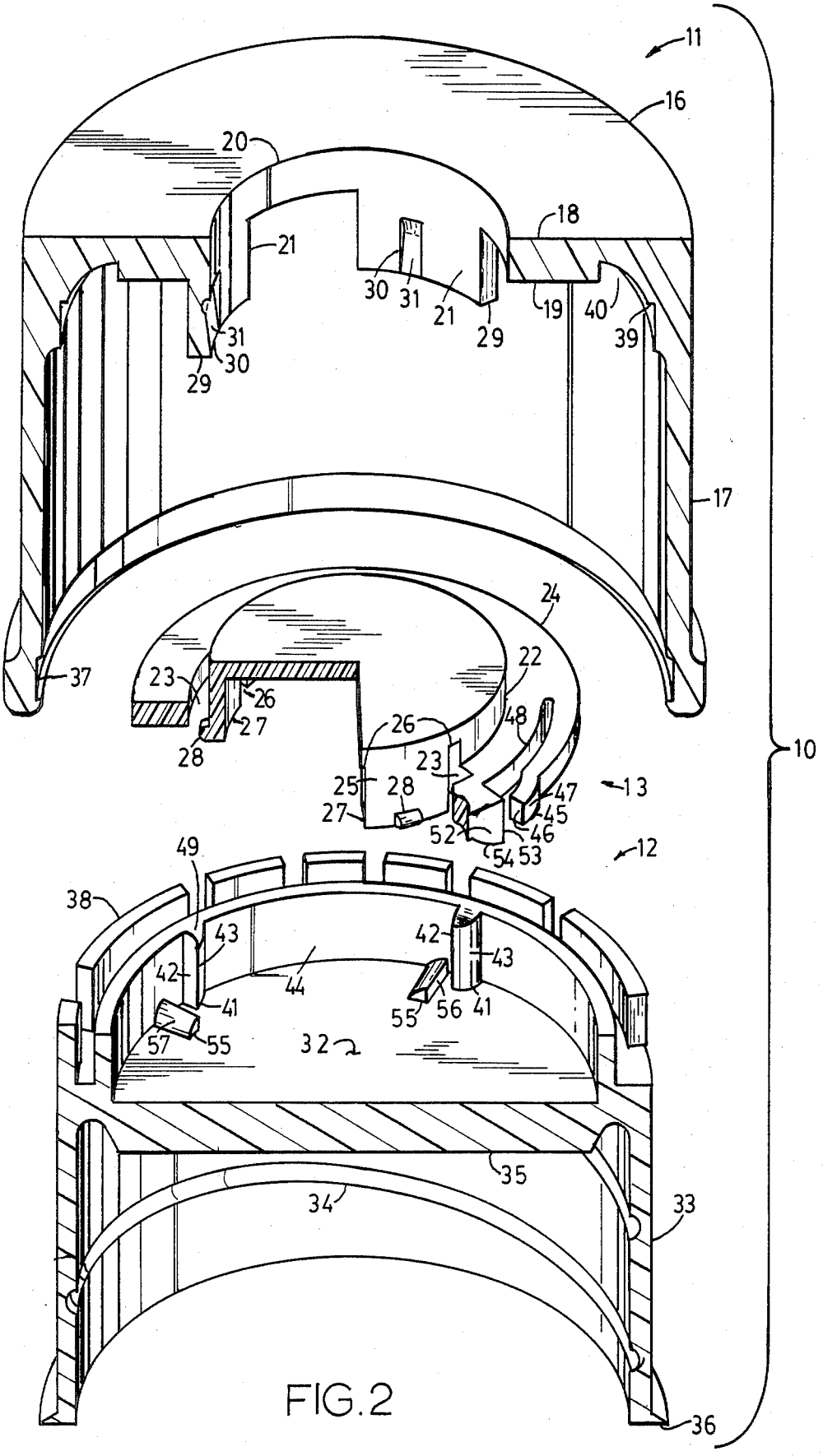
FIG. 2 is an exploded, radially sectioned, perspective view of the members of the closure assembly, of the present invention.
Figure 3:
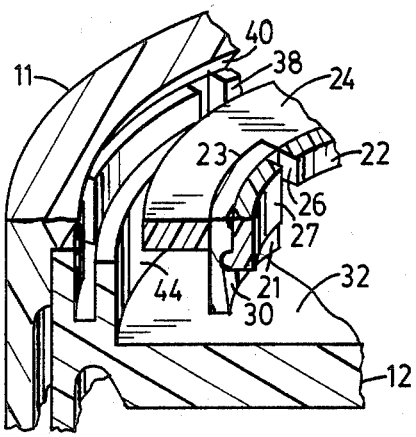
FIG. 3 is a perspective view of a portion of FIG. 1, further sectioned along line 3—3, showing an outer cap locking lug depending through a selector bottom portion slot, and a co-acting selector axial locking arm lip and locking lug cam detent in the closure assembly child-resistant mode.

In reference to FIG. 2 to describe the construction of the various portions of the closure assembly, it is shown that outer cap 11 is comprised of a circular top portion 16 and an annular skirt 17 depending from the periphery thereof. Top portion 16 includes a top surface 18 and a bottom surface 19 with a centrally located opening 20 therebetween. Formed therewith bottom surface 19, axial locking lugs 21 depend from the periphery of opening 20 for a distance to be presently described. Upstanding cylinder portion 22 of selector 13 is received moveably by outer cap opening 20 while outer cap axial locking lugs 21 are received moveably by cooperatively spaced selector slots 23 (FIGS. 3–6) thereby forming a rotationally locked engagement therebetween the outer cap and selector.

Selector 13 is integrally formed as one-piece comprising of said cylinder portion 22 and a bottom disc-shaped portion 24 as the main components thereof. Said selector slots 23 are formed therethrough disc portion 24 and include an interior radial circumferential surface 25 coexistive with the exterior surface of cylinder 22. Within the included angle of at least one slot 23, a pair of axially extending slots 26 therethrough cylinder 22, beginning at a point slightly below the top of the cylinder and continuing downward therefrom, describes a resiliantly radial flexible selector axial locking arm 27, at least one such arm including a bottom lip portion 28 extending radially outward for a portion of the radial width of cojointly formed slot 23. Each outer cap axial locking lug 21 adapted to be engaged therethrough a slot 23 wherein there is a locking arm 27 and a lip portion 28, includes a bottom face 29 and an integral cam detent 30 extending upwards therefrom. Locking arm lip portions 28 are received by locking lug cam detents 30 whereby contact therebetween cam detent faces 31 and the lips retain the selector in an axial relative outward first position. It is illustrated in FIG. 1 that selector locking arms 27 stand rigidly vertical and the top of the selector is essentially in the same horizontal plane with outer cap top portion top surface 18 when the selector is in the axial relative outward first position.

A modification of the outer cap opening and selector cylinder portion (not shown) will also form a rotationally locked engagement therebetween the selector and outer cap. According to the modification, in top plan, the outer cap opening and selector upstanding top portion may be formed in the shape of an ellipse or rectangle, as by way of example, and the outer cap axial locking lugs may be omitted. Further, therewith, the modification, the locking lug cam detents may be formed therein the sides of the outer cap opening and cooperate with radially outwardly extending tabs formed thereon the modified selector upstanding portion to retain the selector in an axial relative outward first postion. The modification is not the preferred form of the present invention, however, because it would make the cooperatively formed cam detents and selector tabs difficult to form so as to maintain their herein specified function.

The outer cap-selector assembly is engaged telescopically over the inner cap to form a permanent nested configuration as illustrated in FIG. 1. In reference to the construction of the inner cap shown in FIG. 2, it is illustrated that inner cap 12 includes a circular top portion 32 and an annular skirt 33 depending from the periphery thereof. Inner cap skirt 33 includes internal screw threads 34 adapted to engage a container screw threaded neck portion but my be adapted to include external screw threads (not shown) to engage a container internally threaded neck portion. Further, inner cap top portion 32 may include a bottom surface 35 formed in the shape of a plug to provide a moisture-proof seal therewith a container mouth portion. The outer cap-selector assembly has a rotationally free engagement therewith the inner cap (FIGS. 1,2,4) including an annular tongue 36 extending radially outward from inner cap skirt 33 engaged therein annular groove 37 formed on the interior surface of outer cap skirt 17. Upstanding circumfrientially spaced spring elements 38, formed along the periphery of inner cap top portion 32, engage outer cap top portion bottom surface annular rim 39 and retains the outer cap-selector assembly in an axial relative outward first position wherein the outer cap selector assembly rotates freely and transmits no rotational torque to the inner cap.

Figure 4:
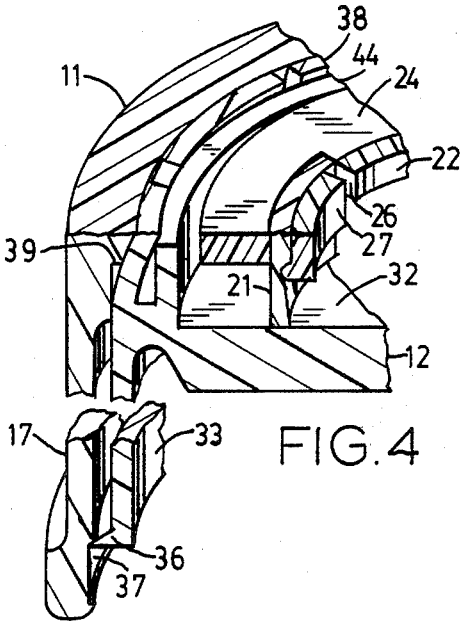
FIG. 4 is a view similar to FIG. 3, but showing the outer cap member in the axial relative inward second position thereby carrying selector closing rotational driving means to an axial engageable position.
Figure 5:
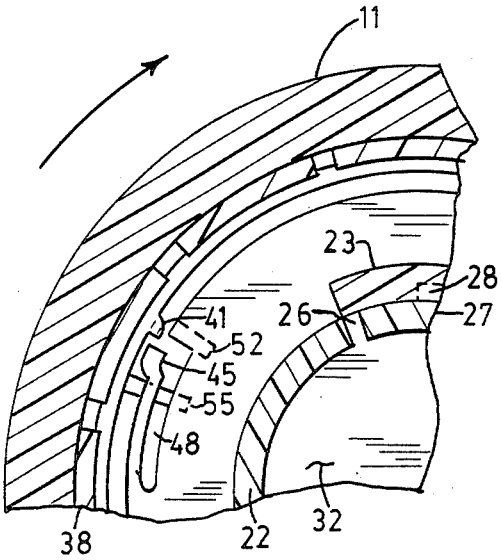
FIG. 5 is a top plan view of FIG. 4, illustrating a selector closing tooth drivingly engageing an inner cap closing lug by rotating the outer cap in the closure assembly closing rotational direction indicated by the arrow.
Figure 6:
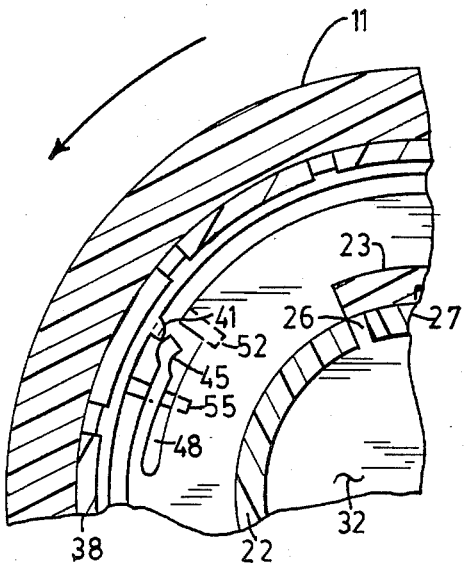
FIG. 6 is the same view as FIG. 5, but showing the selector closing tooth ratcheting past an inner cap closing lug by rotating the outer cap in the closure assembly removal rotational direction indicated by the arrow.

The closure assembly is in a child-resistant mode when the push button selector is in the previously describe axial relative outward first position, but selector closing rotational driving means may be carried to an axial engageable position by depressing the outer cap. With reference to FIG. 4, in any relative angular orientational alignment, axial inward force applied thereto the outer cap causes, spring elements 38 to disengage annular rim 39 and bend radially inward allowing the outer cap to move axially inward. Outer cap top portion bottom surface groove 40 is provided to maintain unobstructive axial clearance therebetween said bent spring elements and bottom surface 19 as the outer cap moves axially inward helping to insure that the spring element maintain resiliency as they may easily obtain a permanent radially inwardly curve if caused to bend from contacting the bottom surface and subsequently be unable to yieldingly return the outer cap to the axial relative outward first position. The outer cap is in an axial relative inward second position when outer cap locking lugs 21 contact inner cap top portion 32.

Referring back to FIG. 2, inner cap top portion 32 includes upstanding closing lugs 41 (2 illustrated), adapted to rotate the inner cap in the closure assembly closing direction, circumfrientially spaced in an arc equidistant from the center of the cap, the diameter of the arc being necessarily slightly greater than the diameter of the selector disc portion 24. The closing lugs include a substantially vertical engagement face 42 and a rounded body portion 43 extending radially outward therefrom the radially inward edge of the lug in the clockwise rotational direction. The lugs extend radially inward and are formed therewith annular ring 44 which is provided, according to one embodiment of the present invention, to give the lugs stability, but which may be omitted. Selector disc portion 24 includes at least one radially inwardly flexible closing tooth 45, extending radially outward in a curvilinear fashion from the exterior of the disc. Each closing toothed formed therewith the disc includes a substantially vertical engagement face 46 and a curvilinear body portion 47 formed radially outward from a slot 48 therethrough a portion of the periphery of the disc. By depressing the outer cap to the axial relative inward second position illustrated in FIG. 4, selector disc portion 24 is carried axially inward relative to the inner cap thereinto the open area between the inner cap closing lugs. Selector closing teeth 45 drivingly engage inner cap closing lugs 41 by rotating the outer cap in the closure assembly closing rotational direction indicated by the directional arrow in FIG. 5, but the closing lug rounded body portion 43 causes the closing teeth curvilinear body portion 47 to bend radially inward therein disc portion slots 48 if the outer cap is rotated in the opening closure assembly rotational direction, FIG. 6. In the relative angular orientational alignmentwherein the closing lugs 41 lie axially beneath the closing teeth 45, the radially inwardly and axially downwardly closing lug top bevel 49 (FIG. 2) cause the closing teeth curvilinear body portions 47 to bend radially inward to the like position shown in FIG. 6 as the outer cap is depressed.

Figure 7:
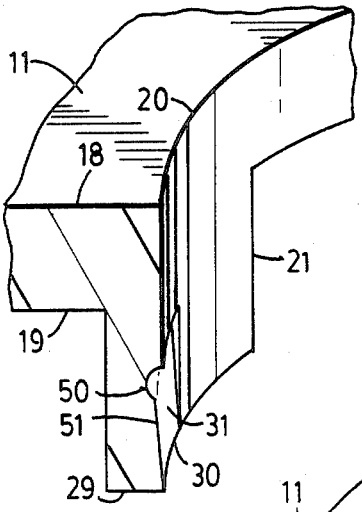
FIG. 7 is an enlargement view through the outer cap axial locking lug and cam detent illustrated in FIG. 2.
Figure 8:
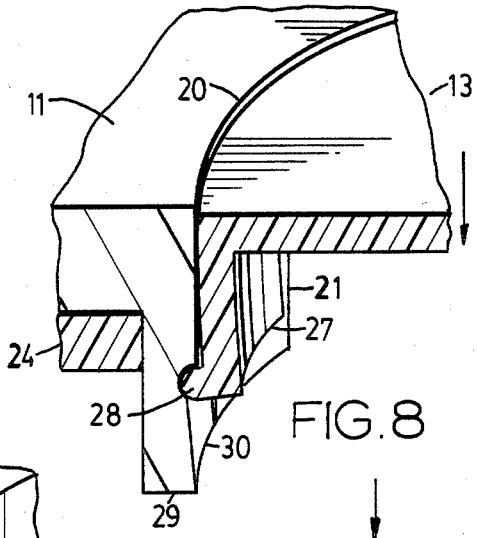
FIG. 8 is a view similar to FIG. 7, but including the corresponding portion of the selector member, illustrating the camming motion of the cam detent illustrated in FIG. 7 thereto the selector axial locking arm lip by an axial inward force applied thereto) the selector, the relative motion being illustrated by arrows.
Figure 9:
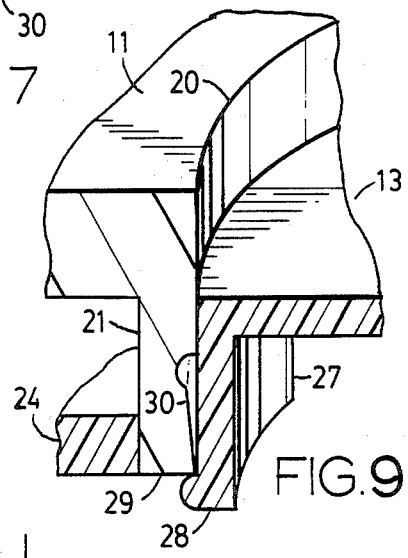
FIG. 9 is a view similar to FIG. 8, but showing the selector member in the axial relative inward second position illustrating the selector axial locking arm lip engaged thereunder the outer cap locking lug and the axial position of the selector disc portion.

Removal of the closure assembly is accomplished by first depressing the push button selector to an axial relative inward second position which can best be understood by first referring to the outer cap locking lug cam detent shown in axial cross section in FIG. 7. Cam detents 30 have an irregularly curved face 31 comprising a radially convexed outward axial inward portion 50 and a radially inwardly sloped portion 51 extending axially outward therefrom. The application of an axial inward force thereto the top of the selector causes selector locking arms 27 to bend radially inwardly relatively quickly as the locking arm lips 28 track (follow) the convex outward portion of the cam detent axially outward (relative to the cam detent, FIG. 8). A constant radially inwardly axially outwardly sloped cam detent face would allow the selector to move axially inward in a direct proportion to the amount of axially inwardly force applied thereto the selector because the locking arms would bend radially inwardly in direct proportion to the locking arm lip axial outward movement, whereas the disclosed radially convexed outward portion of the cam detent face requires a proportionally increasing force applied thereto the selector to cause subsequent inward movement. Sufficient axial inward force applied to the selector causes the selector locking arms 27 to bend radially inwardly to a distance wherein the locking arm lips 28 track axially therebeyond the radially convexed portion and quickly snap axially outward past thee locking lug bottom face 29. It is illustrated in FIG. 9 that the locking arm lip 28 has tracked axially outward therebeyond the locking lug bottom face 29 wherein the radially inwardly bent locking arm has snapped radially outward to cause the lip to engage thereunder the locking lug bottom face. The selector is in an axial relative inward second position when the locking arm lips have snapped thereunder the locking lug.

Figure 10:
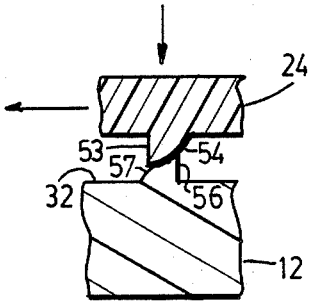
FIG. 10 is a fragmentary axial sectional view through opening rotational driving means in an obstructive angular orientational alignment, illustrating selector relative rotational movement by arrows as the selector moves inward.
Figure 11:
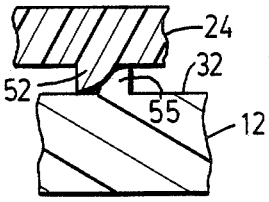
FIG. 11 is the same view shown in FIG. 10, but depicting the relative angular orientational positions of the opening rotational driving means when the selector reaches the axial relative inward second position.

In a further reference to FIG. 2, selector opening teeth 52 depend from selector disc portion 24 and include a vertical engagement face 53 and a rounded body portion 54 extending axially upwards therefrom in the clockwise rotational direction (in top plan). Inner cap top portion opening lugs 55 (2 illustrated) include a vertical engagement face 56 and a rounded body portion 57 extending axially downward therefrom in the counter-clockwise rotational direction. The disclosed selector opening rotational driving means are not carried to an axial engageable position when the selector is carried axially inward by depressing the outer cap. Therefore, the axial depending length of the outer cap axial locking lugs is such to allow only the closing rotational driving means to be in an axial engageable position by depressing the outer cap. When the selector is depressed to the axial relative inward second position, rotating the outer cap in the closure assembly removal direction causes the selector opening teeth to drivingly engage the inner cap opening lugs thereby transmitting opening rotational torque thereto the inner cap. In the relative angular orientational alignment wherein the inner cap opening lugs lie axially beneath the selector opening teeth, the opening means rounded body portions 54 and 57 cause the rotationally locked selector-outer cap assembly to rotate slightly in the counter clockwise (opening) rotational direction as the selector moves inward. The axial cross sectional side view of a pair of opening means in an obstructive relative angular orientational alignment of FIG. 10 illustrates the resulting angular movement of the selector by the arrow as the selector is depressed, and, further, FIG. 11 illustrates the angular relationships of the same opening means when the selector reaches the axial relative inward second position. FIG. 11 also illustrates that the selector is in essentially the lowest axial position relative to the inner cap in the axial relative inward second position.

In a further reference to FIG. 2, it is illustrated that inner cap opening lugs 55 do not lie in the same angular plane therewith inner cap closing lugs 41, but rather form a counterclockwise rotational angle therewith, while vertical engagement faces 46 and 53 of selector rotational driving means 45 and 52 lie in a relatively closer angular plane. With the selector in the previously described axial relative inward second position, rotating the outer cap in the closure assembly removal (counterclockwise) rotational direction, the described angular placement of the inner cap rotational driving means allows the selector closing means to ratchet past the inner cap closing lugs before the opening means engage. In the relative angular orientational alignment wherein the opening means are engageable, subsequent rotation of the outer cap in either direction will cause either the opening or closing means to engage.

Figure 12:
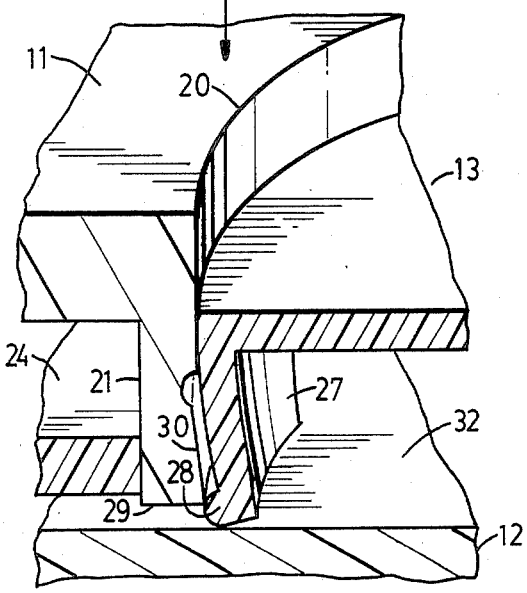
FIG. 12 is a view similar to FIG. 9, but showing the selector axial locking arm lip being forced to move radially inward by depressing the outer cap, the movement being shown by arrows.
Figure 13:
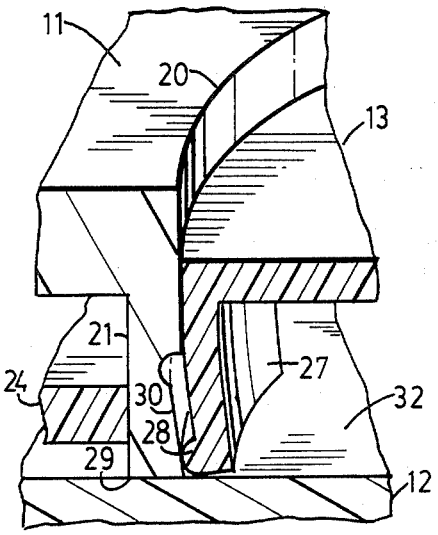
FIG. 13 is a view similar to FIG. 12, but depicting the selector axial locking arm lip illustrated in FIG. 12 engaged therein the outer cap axial locking lug cam detent when the outer cap has been depressed to the axial relative inward second position.

The closure assembly remains in an operational mode indefinitely during subsequent use, but can be returned to a rotationally free child-resistant mode by depressing the outer cap. Because the selector is in essentially the closest axial position relative to the inner cap when in the axial relative inward second position (FIG. 11), depressing the outer cap causes outer cap locking lugs 21 to place axial inward force on selector locking arm lips 28. The locking arm lips are slightly rounded on the top causing locking arms 27 to bend radially inward as the locking lugs move axially inward as illustrated in FIG. 12. In reference to FIG. 13 when locking lug bottom face 29 contacts inner cap top portion 32, selector locking arm lip 28 is engaged within bottom portion 51 of cam detent 30. The function of lower portion 51 of cam detent 30 is to translate the radially outwardly biasing force of the bent selector arms to axially inward movement of the lips (relative to the cam detent) and axially outward movement of the selector. It will be appreciated by those skilled in the art of forming thermoplastic parts by the injection molding process, that the cam detents are easily formed in the depending lugs while forming the disclosed cam detent (requiring a radially sloped inward portion extending axially outward) in the side portion of an opening would require the use of a complex and expensive mold. By depressing the outer cap, the closure assembly returns to the position illustrated in FIG. 4; when the outer cap is released, the closure assembly returns to the position illustrated in FIG. 1.

In a further reference to FIGS. 10 and 11, if the opening means are brought into contact by rotating the outer cap in the closing direction, the rounded body portions would impart an axially upward force there to the selector leading to an obvious modification of the present invention. Closing means may be formed in the same manner as the disclosed opening means, (i.e. depending from bottom of the selector and formed on the inner cap top portion) differing only in the rotational direction of the outer cap required to ring the engagement faces into contact. If the depending closing means are formed with a sloped engagement face, tightening the closure assembly would cause the selector axially upward, and in the same herein disclosed manner, the selector locking arm lips would engage within the cam detents and the selector would return to the axial relative outward first position. Therewith this modification, it would not be necessary to adapt the outer cap to be able to move in the axial direction. This modification is not the preferred form of the present invention, however, because the closing rotational driving means could not be brought into an axial engageable position without depressing the selector.

The preferred form of the present invention is useful on any container and is particularly useful as a tamper-resistant closure. A common means employed to render a container tamper-resistant is to secure a frangilbe seal around the closure and container after the container has been filled and the closure secured thereto, wherein the seal must be broken before the closure may be subsequently removed. The present invention may employ a frangible seal secured to the closure when the closure is made. The seal, as by way of example, may be formed of paper, plastic, or a like material, and so secured in a manner such that the seal must be broken in order to depress the selector. Because the present invention may be secured to a container by depressing the outer cap while rotating in the closing direction, it is not necessary to secure the seal in place after the closure is secured to a container.

While there has herein been disclosed a closure assembly employing certain rotational driving means therebetween the inner cap and selector and therewith illustrated in the accompanying drawing, a certain number and angular placement of said means, it should be understood that any number of such means may be employed and arranged in any angular placement. Further, other rotational driving means (not shown), wherein other means are carried to an axial engageable position via the axial positioning of the selector, may be used.

It should be understood that the various terms and expressions used in the foregoing specific and illustrated in the accompanying drawings, are illustrative and explanatory, thereof, and there is no intention in the use of such terms and expressions, of excluding any equivilants of the features shown or described. It will be appreciated by those skilled in the art, that various modifications of the parts, or the portions thereof, the type of material used to form the parts or portions of the closure assembly are possible within the scope and spirit of the invention.

I claim:

1. A rotationally-free child-resistant closure assembly for containers convertible to an operable position by an axially depressable member, comprising;

an inner cap member including a top portion and an annular skirt depending therefrom, the inner cap member top portion including rotational driving means formed thereon, said inner cap member top portion adapted to provide a closure for the open mouth portion of a container, the inner cap member skirt including rotational engagement means formed thereon for engagement with a container rotational engagement means by a rotational movement of the closure assembly;

an outer cap member including a top portion and an annular skirt depending therefrom, the outer cap member engaged telescopically over said inner cap member, the outer cap member top portion including an opening formed therethrough and a member depending from the lower surface of said top portion, the outer cap member skirt including a rotationally free swivel connection therewith said inner cap member skirt;

a selector member including an upstanding top portion and a perpendicular bottom portion, the selector member totp portion moveably received by said outer cap member top portion opening, the selector member bottom portion including an opening formed therethrough receiving said outer cap member top portion depending member to transmit rotational torque therebetween said outer cap and selector members, said selector member top portion including a radially flexible portion within the included rotational angle of said bottom portion opening, the radially flexible portion including a lip portion;

said outer cap member depending portion including a detent formed therein adapted to receive said selector member flexible portion lip to hold said selector member in an axial relative outward first position, the depending portion detent adapted to allow said selector member flexible portion lip to disengage said detent and allow said selector member to move axially inward therewith the application of an axially inward force applied thereto said selector member, said outer cap member depending portion adapted to receive said selector member flexible portion lip thereunder and hold said selector member in an axial relative inward second position;

said selector member bottom portion including rotational driving means formed thereon, the selector member driving means adapted to drivingly engage said inner cap rotational driving means therewith the selector in said axial relative inward second position.

2. The child-resistant closure as set forth in claim 1 wherein;

said selector member flexible portion is formed by a pair of axially extending slots extending therethrough said selector member top portion within the included angle of said selector member bottom portion opening.

3. The child-resistant closure as set forth in claim 1 wherein:

said outer cap member depending portion including severally disposed circumfrential spaced lugs depending from the periphery of said outer cap member opening.

4. The child-resistant closure as set forth in claim 1, wherein;

said outer cap depending member detent including a radially convex outward axially inward portion and a radially inwardly sloped portion extending axially outward therefrom.

5. The child-resistant closure assembly as set forth in claim 1, wherein;

said inner cap member rotational driving means including a vertical engagement face adapted to be engageable by said selector rotational driving means by rotating the closure assembly in the opening direction and a sloped engagement face adapted to force said selector member bottom portion axially upwards therewith rotating the closure assembly in the closing direction.

6. The child-resistant closure asssembly as set forth in claim 1, wherein;

said outer cap depending member detent adapted to receive said selector member flexible portion lip as said selector member is forced axially upward and further adapted to carry said flexible portion lip axially upward and return said selector to said axially relative outward first position.

7. A rotationally free child-resistant closure for containers convertible to a screw-type closure by a push button selector, comprising;

an inner cap member including a circular top portion and an annular skirt depending from the periphery thereof, the inner cap skirt having rotational engagement means formed thereon for engagement with container rotational engagement means, the inner cap top portion including a bottom surface adapted to close the open mouth portion of a container and a top surface having rotational driving means formed thereon;

an outer cap member including a circular top portion and an annular skirt depending from the periphery thereof, the outer cap member encompassing said inner cap member, the outer cap member top portion having an opening formed therethrough and an axial locking lug depending from the lower surface of said outer cap member top portion, the outer cap member skirt having swivel connection with said inner cap member skirt that permits free rotational and limited axial movement therebetween sad inner and outer cap members;

a selector member including an upstanding top portion and a perpendicular bottom portion, the selector top portion being axially insertable in said outer cap opening, the selector bottom portion including at least one opening formed therethrough where said outer cap member axial locking lug is axially insertable for transmission of rotational torque therebetween said outer cap and selector members while permitting limited axial movement therebetween said outer cap and selector members;

said selector member top portion having a radial flexible axial locking arm within the included angle of said selector member bottom portion opening, the selector member axial locking arm including a perpendicular lip portion;

spring elements formed on one of said inner or outer cap members engaging a portion of other said cap member, the spring elements adapted to hold said outer cap member in an axial relative outward first position, said spring elements adapted to yieldingly bend radially inwardly thereupon axial inward force applied thereto the outer cap member to allow said outer cap member to move axially inward to an axial relative inward second position, said spring elements adapted to yieldingly urge said outer cap member toward said axial relative outward first position thereupon being bent radially inwardly, said spring elements adapted to stand rigidly vertical therewith said outer cap member axial relative outward first position;

said outer cap member axial locking lug including a flat bottom face and an interal cam detent extending axially upward therefrom, the integral cam detent adapted to receive said selector member axial locking arm lip portion when said selector member is in an axial relative outward first position thereby retaining said selector member in said axial relative outward first position, said integral cam detent adapted to cammingly move said selector member axial locking arm lip portion radially inwardly to cause said selector member axial locking arm to bend radially inward therewith axial inward movement of said selector member, said outer cap member axial locking lug bottom face adapted to receive said selector member axial locking arm lip portion thereupon said selector member in an axial relative inward second position;

said selector member bottom portion including rotational driving means formed thereon, the selector member bottom portion rotational driving means adapted to drivingly engage said inner cap member top portion rotational driving means in the opening rotational direction only when said selector member is in said axial relative inward second position;

said outer cap member axial locking lug bottom face adapted to receive said selector member axial locking arm lip portion only when said outer cap member is in said axial relative outward first position.

8. The convertible child-resistant closure as set forth in claim 7, wherein;

said spring elements are circumfrentially spaced upstanding portions of said inner cap member annular skirt, the spring elements adapted to engage an annular rim formed thereon said outer cap member annular skirt to retain said outer cap member in an axial relative outward first position and to disengage said outer cap member skirt annular rim therewith the application of an axial inward force applied thereto said outer cap member to allow relative axial inward movement of said outer cap member.

9. The convertible child-resistant closure as set forth in claim 7, wherein;

said selector member including a centrally located upstanding cylindrical top portion and a circular disc bottom portion.

10. The convertible child-resistant closure as set forth in claim 7, wherein;

said selector member bottom portion opening is comprised of a plurality of circumfrentially spaced slots formed therethrough said selector member bottom portion at the base of said selector member upstanding top portion so that the radial exterior surface of said selector member upstanding top portion is coexistive with the radial interior circumfrential surfaces of said selector member bottom portion slots.

11. The convertible child-resistant closure as set forth in claim 7, wherein;

said inner cap member top portion top surface rotational driving means including at least one upstanding closing lug, the closing lug including a flat engagement face coexistive with the radius of said inner cap member and a rounded body portion extending radially outward therefrom the radial inner edge of said closing lug face in the clockwise rotational direction, said inner cap top portion closing lug formed radially outward from at least one opening lug, the inner cap opening lug including a flat engagement face coexistive with the radius of said inner cap top portion and a rounded body portion extending axially downward therefrom the top of said inner cap opening lug in the counter clockwise rotational direction.

12. The convertible child-resistant closure as set forth in claim 7, wherein;

said selector bottom portion rotational driving means including at least one radially inwardly flexible closing tooth extending radially outward in the clockwise rotational direction therefrom the periphery of said selector member bottom portion, said select member closing tooth including a flat engagement face essentially coexistive with a radius of said selector member bottom portion, said selector member bottom portion rotational driving means including at least one opening tooth depending from the lower surface of said selector member bottom portion, the selector member opening tooth including a flat engagement face essentially coexistive with a radius of said selector member bottom portion and a rounded body portion extending axially upwards therefrom the bottom of said opening tooth flat face in the clockwise rotational direction, said selector member closing tooth adapted to be in a relative axial engageable position with said inner cap member top portion closing lugs by either carrying said selector member axially inward therefrom depressing said outer cap member to said outer cap member axial relative inward second position or carrying said selector member axially inward to said selector member axial relative inward second position, said selector member closing tooth adapted to drivingly engage said inner cap member top portion closing lug by rotating said outer cap member in the closing rotational direction but ratchet past said inner cap member top portion closing lug by rotating said outer cap member in the opening rotational direction, said selector member opening tooth adapted to be in a relative axial engageable position with said inner cap member top portion opening lug only by depressing said selector member to said selector member axial relative inward second position, said said selector member opening tooth adapted to drivingly engage said inner cap member top portion opening lug by rotating said outer cap member in the opening rotational direction.

13. The convertible child-resistant closure as set forth in claim 7, wherein;

said inner cap member top portion rotational driving means including a plurality of circumfrentially spaced upstanding closing lugs formed in an arc equidistant from the center of said inner cap member top portion and a plurality of opening lugs formed in an arc radially inward from said closing lug arc, said inner cap member top portion opening lugs formed to produce a counter clockwise included angle relative to said inner cap member closing lugs.

14. The convertible child-resistant closure as set forth in claim 7, wherein;

said outer cap member axial locking lug cam detent including a radially convex outward axial inward portion and a radially inwardly sloped portion extending axially outward therefrom.

15. The convertible child-resistant closure as set forth in claim 7, wherein;

said selector member axial locking arm adapted to be engaged thereunder said outer cap member axial locking lug only with said outer cap member in an axial relative outward first position.

* * * * *